US006295704B1

(12) United States Patent
Rivas

(10) Patent No.: US 6,295,704 B1
(45) Date of Patent: Oct. 2, 2001

(54) APPARATUS FOR SECURING LACES ON FOOTWEAR

(76) Inventor: Juan Rivas, 11 Harnett Rd., Havelock, NC (US) 28532

( * ) Notice: Subject to any disclaimer, the term of this patent is extended or adjusted under 35 U.S.C. 154(b) by 0 days.

(21) Appl. No.: 09/263,356

(22) Filed: Mar. 5, 1999

(51) Int. Cl.[7] ..... A43B 5/00; A43C 7/00; B65D 63/00; F16G 11/00

(52) U.S. Cl. ..... 24/712.1; 24/306; 24/712.2; 24/712.9

(58) Field of Search ..... 24/712.1, 712, 24/712.2, 713.6, 714.1, 715.3, 712.9, 442, 306, 17 B, 17 AP, 16 PB; 36/50.1, 89

(56) References Cited

U.S. PATENT DOCUMENTS

| | | | | |
|---|---|---|---|---|
| D. 270,779 | * | 10/1983 | Steinberg | 24/306 |
| 729,305 | * | 5/1903 | Evans | 24/712.9 |
| 3,403,429 | * | 10/1968 | Smith | 24/442 |
| 3,501,774 | * | 3/1970 | Norman | 24/306 |
| 3,765,694 | * | 10/1973 | Allsop | 24/16 PB |
| 4,428,101 | | 1/1984 | Harkavy | 24/117 |
| 4,514,882 | * | 5/1985 | Lavielle | 24/712.1 |
| 4,553,293 | * | 11/1985 | Blum | 24/712.2 |
| 4,571,854 | | 2/1986 | Edens | 36/50 |
| 4,571,856 | * | 2/1986 | Lin et al. | 36/89 |
| 4,780,936 | | 11/1988 | Brecher | 24/119 |
| 4,878,274 | | 11/1989 | Patricy | 24/306 |
| 4,879,787 | | 11/1989 | Walls | 24/712.2 |
| 4,999,888 | | 3/1991 | Miller | 24/712.3 |
| 5,016,327 | * | 5/1991 | Klausner | 24/442 |
| 5,040,274 | | 8/1991 | Keech | 24/381 |
| 5,042,119 | | 8/1991 | Williams | 24/712.3 |
| 5,131,108 | | 7/1992 | Sessa et al. | 12/142 |
| 5,170,573 | * | 12/1992 | Clinch | 24/712.2 |
| 5,416,987 | * | 5/1995 | Bemis et al. | 36/50.1 |
| 5,430,960 | * | 7/1995 | Richardson | 36/89 |
| 5,778,500 | * | 7/1998 | Illingworth | 24/712 |

FOREIGN PATENT DOCUMENTS

| | | | | |
|---|---|---|---|---|
| 0005057 | * | of 1890 | (GB) | 24/712.1 |

* cited by examiner

*Primary Examiner*—Victor N. Sakran
(74) *Attorney, Agent, or Firm*—Linsay G. McGuiness, Esq.

(57) ABSTRACT

An expandable, self-fastening strap includes a pair of fastening ends separated by a band, at least a portion of which is expandable. Located on one of the fastening ends is an eyelet. At least a portion of the laces of a boot may be forwarded through the eyelet. The strap and lace combination is wrapped around the boots, with the strap covering the laces, until the fastening ends of the strap meet. The fastening ends are then fastened together. Because at least a portion of the band is expandable, when the band is wrapped around the boot pressure is placed upon the laces, thereby precluding them from slipping under the strap. The strap thus secures the laces without undesirably constricting circulation of the wearer. As a result, wearer fatigue and discomfort is reduced. In addition, because the strap is tightly affixed to the boot, the device presents no extraneous protrusions that may become entangled in machinery or the like.

8 Claims, 4 Drawing Sheets

APPARATUS FOR SECURING LACES ON FOOTWEAR

FIELD OF THE INVENTION

This invention relates generally to the field of footwear and more specifically to an apparatus for securing laces for footwear.

BACKGROUND OF THE INVENTION

Flexible laces are typically used to securely fasten shoes, sneakers, boots and other types of footwear. In most instances, after the lace is tightened on the footwear, the ends are tied in conventional bow-knots. It is well known that such bow-knots have a tendency to loosen or become untied, which is inconvenient and hazardous, particularly when the footwear is to be used in a dangerous occupation. Such occupations include those in which the laces could become tangled with machinery or other equipment, such as in construction, military, law enforcement, emergency services and the like.

Because of the danger posed by exposed laces, in many fields of work it is often required that laces on a boot or other article of footwear be secured in the interior of the footwear for safety purposes. For example, one requirement of a military dress code requires that, after a boot has been tied, the extra laces be tucked inside the boot. A typical method of securing the laces is to lace and knot the boots, circle the laces around the boot, tie the laces and tuck any remainder portions of the laces inside the boot. One problem with this method is that when boots are secured in this manner, over the course of the day in which the boots are worn the laces tend to bind into the leather of the boot and produce pressure on the lower portion of the wearer's leg. The pressure cuts of circulation, and may produce uncomfortable swelling and unnecessary fatigue for the wearer.

Many devices have been developed for retaining shoelaces. For example, U.S. Pat. No. 4,999,888 describes a device wherein the bow-knotted laces are rolled in a shoelace retainer. While such a solution may preclude a wearer from tripping over the ends of the laces, the shoelace retainer forms an exterior protrusion from the footwear which could likely become caught on dangerous equipment. It would be desirable to determine a method and apparatus for securing laces without adding any dangerous protrusions to the footwear.

SUMMARY OF THE INVENTION

According to one aspect of the invention, an expandable self-fastening strap for securing laces on footwear is provided. The strap includes a pair of fastening ends separated by a band, at least a portion of which is expandable. Located on one of the fastening ends is at least one eyelet. A portion of the laces of a boot may be forwarded through the eyelet and wrapped around the boot. The strap is wrapped over the laces and around the boot such that the fastening ends of the strap meet. The fastening ends are then fastened together. Because at least a portion of the band is expandable, when the band is wrapped around the boot pressure is placed upon the laces, thereby precluding them from slipping under the strap. In addition, because the strap includes an expandable portion, the strap may expand over the course of the day to comfortably accommodate the leg. The strap thus secures the laces without undesirably constricting circulation of the wearer. As a result, wearer fatigue and discomfort is reduced. In addition, because the strap is tightly affixed to the boot, the device presents no extraneous protrusions that may become entangled in machinery or the like.

According to one aspect of the invention, an apparatus for securing laces of an article of footwear including a strap having a first fastening end, a second fastening end and a band disposed between the first fastening end and the second fastening end, at least a portion of which is expandable and at least one eyelet disposed on one of the first or second fastening ends, for receiving at least a portion of the laces of the article of footwear to engage the strap to the article of footwear.

According to a further aspect of the invention, a method for securing laces on an article of footwear includes the steps of forwarding laces of the article of footwear through at least one eyelet of an expandable strap, the expandable strap comprising a first fastening end in which the eyelet is disposed and a second fastening end and winding the expandable strap and the laces around the article of footwear such that the laces are disposed between the expandable strap and the article of footwear; and securing the first and second fastening ends of the expandable strap where they meet.

BRIEF DESCRIPTION OF THE DRAWINGS

Reference will be made to the attached Figures, where like numerals refer to like elements, and wherein.

DESCRIPTION OF ILLUSTRATIVE EMBODIMENTS

Figure 1:
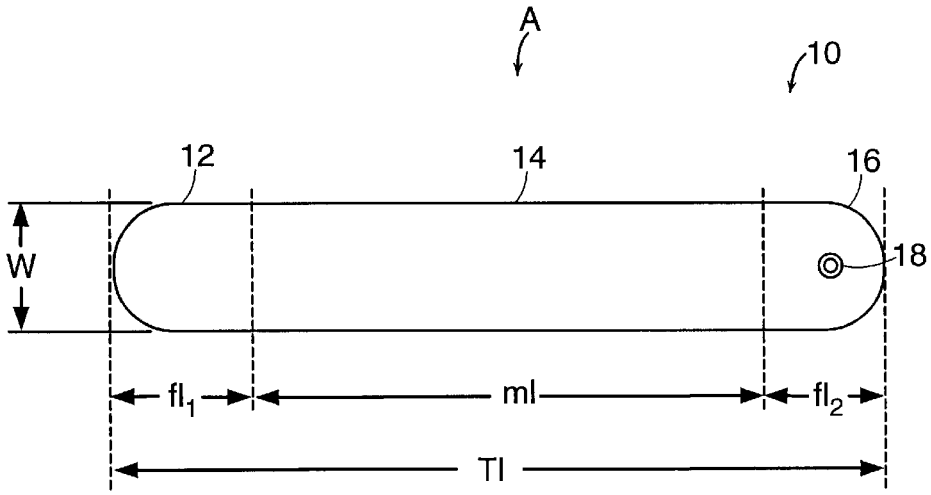
FIG. 1 illustrates one embodiment of a strap designed according to the present invention.

Referring now to FIG. 1, an expandable self-fastening strap 10 according to the present invention is shown to comprise a first fastening end 12 and a second fastening end 16. Joining the first fastening end 12 and the second fastening end 16 is a band 14, at least a portion of which made from an expandable material such as elastic. In the embodiment of FIG. 1, the strap 10 is shown to include an eyelet 18 at the second fastening end 16. The eyelet may be placed at any location within either fastening end, however, and therefore the present invention is not limited to any particular placement of the eyelet.

In one embodiment, the strap 10 is formed from a heavy stretch elastic band, such as that provided by Stretch-Rite™ of Rhode Island. Other types of elastics may alternatively be used, and the present invention is not limited to the use of the Strech-Rite™ material. In an embodiment where the strap is to be used for securing laces of adult size military boots, the total length Tl of the strap is 11 inches. Using the Strech-Rite™ elastic, the band is capable of extending to an overall length of 17 inches. In general, the total length of the strap should be selected to be shorter than the overall circumference of the article of footwear to be secured, to cause the band to expand in order to be secured. In such a manner, the expanded band will place pressure on the laces to ensure that they are secured underneath the band. Thus, the total length Tl of the strap will vary depending upon the article of footwear that it is to secure.

In one embodiment, the strap 10 has a width w of 1.5 inches. The width is selected according to the width of the laces that are to be secured by the device. For example, if the width of the pair of laces to be secured totals 0.5 inches, the width of the strap may be designed to be 1.5 inches, to allow for 0.5 inch overhang distance between the lace and an edge of the strap. However, the present invention is not limited to any particular overhang distance; rather, a variety of widths may be used provided the width is both sufficient to cover the laces and secure the laces to the boot.

Figure 2:
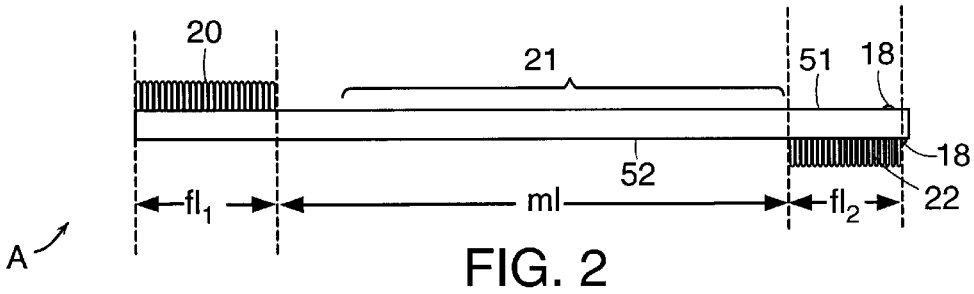
FIG. 2 is a side view of the strap of FIG. 1 viewed along line A of FIG. 1.

FIG. 2 is a view of strap 10 of FIG. 1 taken along line A, and more clearly illustrates the fastening material of the strap. Attached to a first surface of the strap 10 at fastening end 12 is a hook fastener 20, while attached to a second surface of the strap 10 at fastening end 16 is a loop fastener 22. The hook and loop fasteners 20 and 22 are preferably of the type manufactured and sold by Velcro Corporation of New York, N.Y. under the trademark "VELCRO". Providing the fasteners 20 and 22 on opposed surfaces S1 and S2 of the strap 10 allows the two fastening ends to bind when the strap is circled around the ankle of footwear such as a boot.

In one embodiment, the lengths fl1 and fl2 of fastening ends 12 and 14, respectively, are selected to be 2 inches, although the present invention is not limited to any particular length of the fastening ends. Rather, the selection of a length for fl1 and fl2 should be selected such that they are able to secure the strap around the footwear despite the tensile pressure of the elastic band.

Figure 3A:
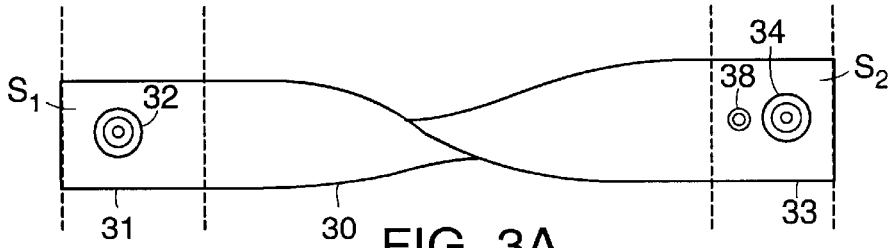
FIGS. 3A and 3B are views of alternate embodiments of the strap according to the present invention.
Figure 3B:
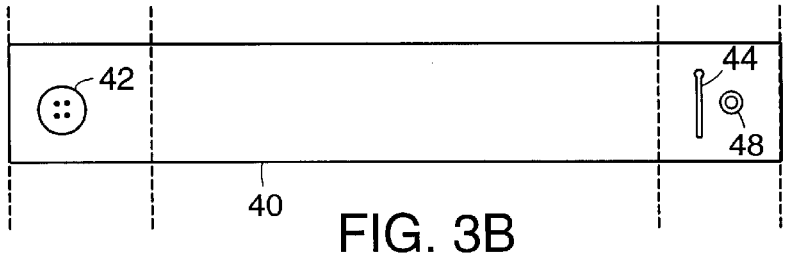

Although FIG. 2 illustrates a hook and loop type fastening device, the present invention is not limited to any particular type of fastener for the strap 10. For example, FIG. 3A illustrates an alternative embodiment of a strap 30, wherein one half of a snap fixture 32 and 34 is provided on each of the opposed surfaces S1 and S2 of the strap 30. Thus, when the strap 30 encircles a boot or other article of footwear, the snap halves 32 and 34 join to securely fasten the strap. Similarly, FIG. 3B illustrates another alternative embodiment of a strap 40, wherein a button 42 and button-hole 44 are used for fastening the strap. Other types of fasteners, such as hook-and-eye, tab and slot and the like are also envisioned as being embodiments of the invention, and therefore the present invention is not limited to any particular type of fastening device.

Figure 4:
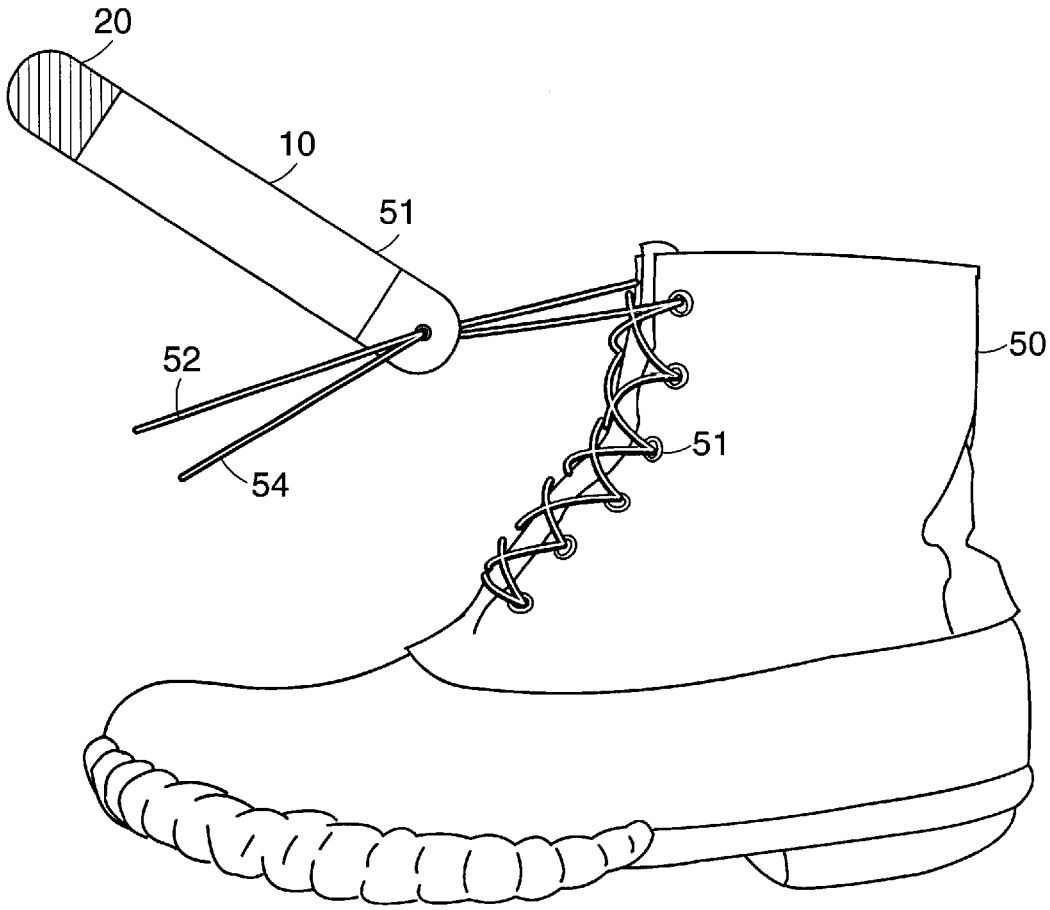
FIG. 4 illustrates the coupling of the strap of FIG. 1 to a boot.
Figure 5A:
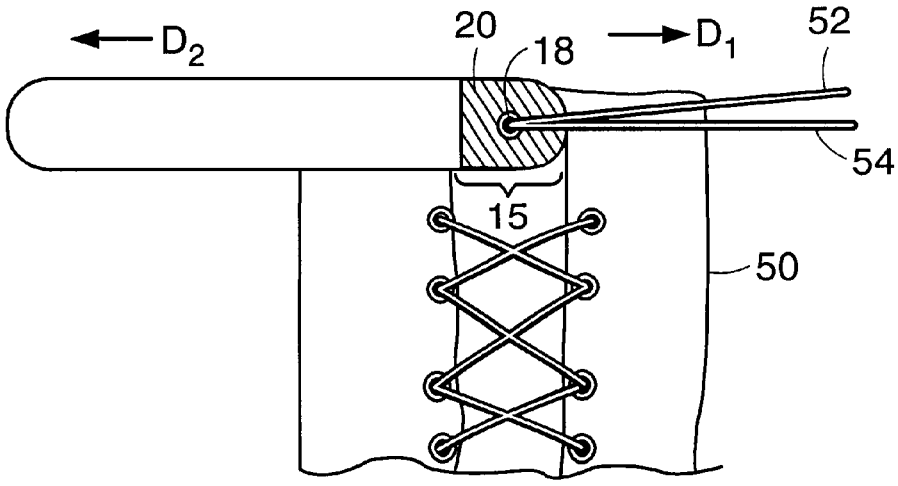
FIGS. 5A and 5B are provided to illustrate the steps of securing the strap of FIG. 1 to the boot of FIG. 4.
Figure 5B:
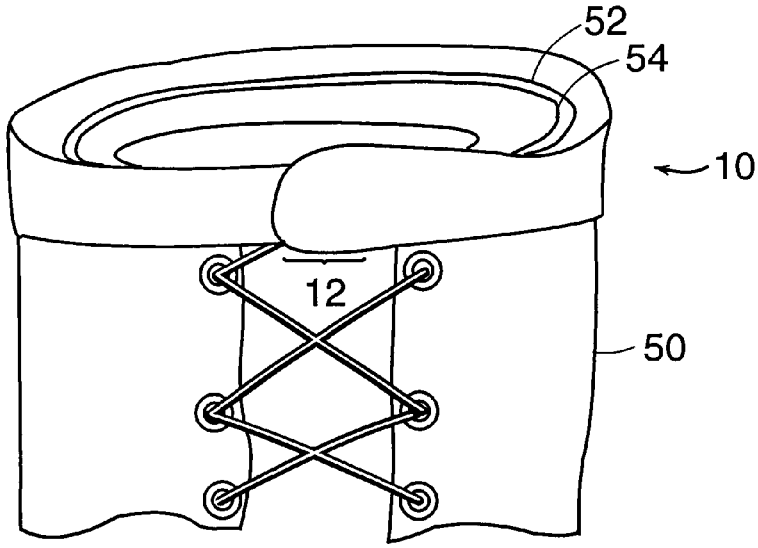

Referring now to FIGS. 4 and 5A–5B, a description of one method of using the strap 10 to secure laces of an article of footwear will now be described. Although the below description describes the fastening of laces of a boot, it should be understood that the invention is equally applicable to any type of footwear providing ankle support, such as adult and children's high-topped sneakers, ladies dress boots and the like.

As shown in FIG. 4, the laces of a boot 50 are first laced through eyelets such as eyelet 51 to a desired height (hereinafter referred to as the neck of the boot). Once the boots have been laced to a desired height, the laces are at least partially extended through the eyelet 18 of the strap 10 from surface S2 of the strap to the surface S1 of the strap as shown in FIG. 4. (Alternatively, the laces may be forwarded through from surface S1 to surface S2). A knot may advantageously be tied in the laces after they have been extended through the strap 10. However, the knot is not necessary, as the relationship between the diameter of the eyelet and the width of the laces may be self-securing.

As shown in FIG. 5A, once the portion of laces have been forwarded through the eyelet 18, the strap positioned with surface S2 facing away from the boot, and is extended in direction D2 and wrapped around boot 50. As the strap is wrapped around the boot, the portion of laces that has not been forwarded through the eyelet will follow the wrapping of the strap. When the laces have been pulled their full length, the strap continues to wrap around the boot, covering the laces as it is wrapped around the boot. As shown in FIG. 5B, the strap 10 continues to be wrapped around the boot 50 until the fastening ends 12 and 16 meet. While in FIG. 5B the ends are shown meeting in the front of the boot it should be understood that the ends may meet anywhere around the circumference of the neck of the boot. In fact, the point of fastening may be controlled by the wearer adjusting the amount of the portion of laces that are originally forwarded through the eyelet. The fasteners 22 and 20 are then secured and the laces are held neatly and comfortably out of sight.

Figure 6:
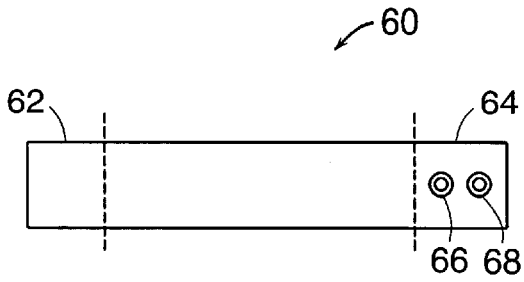
FIG. 6 illustrates another embodiment of a strap according to the present invention.
Figure 7A:
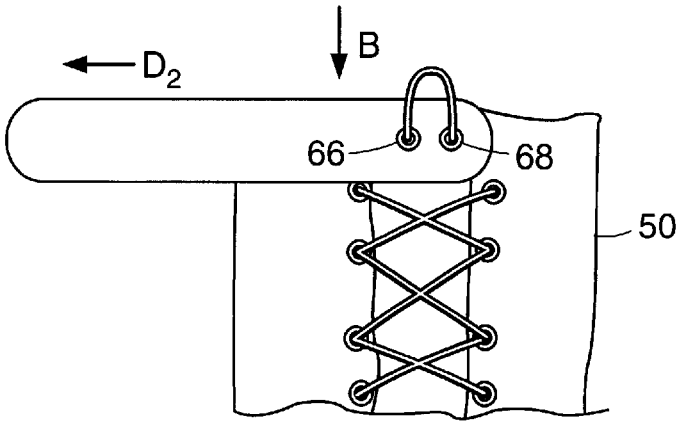
FIGS. 7A and 7B illustrate one exemplary method for securing laces of a boot using the strap of FIG. 6.
Figure 7B:
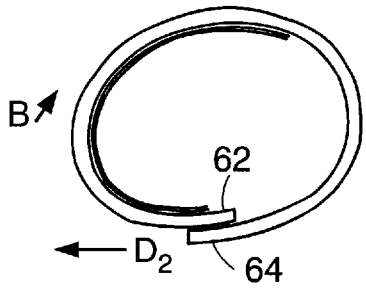

Referring now to FIG. 6, another embodiment of a strap 60 is shown to include two eyelets 66 and 68 on fastening end 64. The pair of eyelets may be used as shown in FIGS. 7A and 7B. As shown in FIG. 7A, when attaching the strap 60 to the boot 50, the laces would first be passed through eyelet 68 towards the front of the boot, then back through eyelet 66 so that the laces lie between the boot and the strap. The combination of laces and strap could then be wrapped in the same direction D2 around the boot. FIG. 7B is a top-down view of the strap 60 and lace combination. As seen in FIG. 7B, the laces will continue to wrap around the boot until they have ended. At that point, the strap 60 continues to wrap until the fastening ends 62 and 64 are joined.

Having described various embodiments of the invention, it will now become apparent to one of skill in the art that other embodiments incorporating its concepts may be used. It is felt, therefore, that this invention should not be limited to the disclosed embodiment, but rather should be limited only by the spirit and scope of the appended claims.

What is claimed is:

1. An apparatus for securing laces of an article of footwear around a neck of the footwear, the apparatus comprising:

a strap comprising:

a first fastening end, a second fastening end and a band disposed between the first fastening end and the second fastening end, at least a portion of which is expandable to surround the neck of the footwear, wherein the first fastening end and the second fastening end comprise fasteners on opposing surfaces of the strap, such that when the strap is encircled, the fasteners of the first and second fastening ends are joined; and at least one eyelet disposed on one of the first or second fastening ends, for receiving the laces of the article of footwear to engage the strap to the article of footwear.

2. The apparatus according to claim 1, wherein the first fastening end comprises a hook fastener on a first surface of the strap and wherein the second fastening end comprises a loop fastener on a second surface of the strap.

3. The apparatus according to claim 1, wherein the first and second fastening ends comprise a snap.

4. The apparatus according to claim 1, wherein the first and second fastening ends comprise a button and button-hole pair.

5. The apparatus according to claim 1, wherein the portion of the band that is expandable is comprised of elastic.

6. The apparatus of claim 1, wherein the strap has a length L which is less than the circumference of a neck of the article of footwear.

7. The apparatus of claim 1, wherein the strap has a width W which is greater than twice the width of the laces of the article of footwear.

8. The apparatus according to claim 1 wherein, during use, the strap encircles a neck of the article of footwear such that the laces are positioned between the strap and the article of footwear, the first and second fastening ends are joined, and wherein the band places pressure upon the laces to secure the laces under the strap.

* * * * *